US009140506B2

(12) United States Patent
Gomez

(10) Patent No.: US 9,140,506 B2
(45) Date of Patent: Sep. 22, 2015

(54) FIREARM RECEIVER ASSEMBLY

(75) Inventor: Jesus S. Gomez, Trappe, MD (US)

(73) Assignee: LWRC INTERNATIONAL LLC, Cambridge, MD (US)

( * ) Notice: Subject to any disclaimer, the term of this patent is extended or adjusted under 35 U.S.C. 154(b) by 329 days.

(21) Appl. No.: 13/562,663

(22) Filed: Jul. 31, 2012

(65) Prior Publication Data

US 2014/0076146 A1 Mar. 20, 2014

(51) Int. Cl.

| | |
|---|---|
| ***F41A 3/64*** | (2006.01) |
| ***F41A 3/66*** | (2006.01) |
| ***F41C 23/16*** | (2006.01) |
| ***F41A 5/18*** | (2006.01) |
| ***F41A 21/48*** | (2006.01) |

(52) U.S. Cl.

CPC ... *F41A 3/66* (2013.01); *F41A 5/18* (2013.01); *F41A 21/487* (2013.01); *F41C 23/16* (2013.01)

(58) Field of Classification Search

CPC ..... F41C 23/16; F41C 23/10; F41C 27/00; F41A 21/48; F41A 11/02

USPC ..... 42/75.01, 75.02; 89/191.01

See application file for complete search history.

(56) References Cited

U.S. PATENT DOCUMENTS

| | | | | |
|---|---|---|---|---|
| 5,412,895 | A * | 5/1995 | Krieger | 42/75.02 |
| 6,959,509 | B2 * | 11/2005 | Vais | 42/75.02 |
| 7,131,228 | B2 | 11/2006 | Hochstrate et al. | |
| 7,775,150 | B2 * | 8/2010 | Hochstrate et al. | 89/193 |
| 8,141,285 | B2 * | 3/2012 | Brown | 42/71.01 |
| 8,141,289 | B2 * | 3/2012 | Gomez et al. | 42/90 |
| 8,234,808 | B2 | 8/2012 | Lewis et al. | |
| 8,479,429 | B2 * | 7/2013 | Barrett et al. | 42/75.02 |
| 8,689,477 | B2 * | 4/2014 | Gomez et al. | 42/72 |
| 8,726,559 | B1 * | 5/2014 | Mueller | 42/75.02 |
| 8,806,792 | B2 * | 8/2014 | Yan et al. | 42/71.01 |
| 8,806,793 | B2 * | 8/2014 | Daniel et al. | 42/72 |
| 2004/0049964 | A1 * | 3/2004 | Vais | 42/75.02 |
| 2007/0199435 | A1 * | 8/2007 | Hochstrate et al. | 89/191.02 |
| 2010/0319231 | A1 * | 12/2010 | Stone et al. | 42/71.01 |
| 2011/0005384 | A1 | 1/2011 | Lewis et al. | |
| 2011/0016762 | A1 * | 1/2011 | Davies | 42/75.01 |
| 2011/0061281 | A1 * | 3/2011 | Kapusta et al. | 42/71.01 |
| 2011/0247254 | A1 * | 10/2011 | Barnes | 42/71.01 |
| 2012/0042557 | A1 * | 2/2012 | Gomez et al. | 42/90 |
| 2012/0132068 | A1 * | 5/2012 | Kucynko | 89/191.01 |
| 2012/0186123 | A1 * | 7/2012 | Troy et al. | 42/71.01 |
| 2013/0055613 | A1 * | 3/2013 | Gomez et al. | 42/90 |
| 2013/0205637 | A1 * | 8/2013 | Patel | 42/75.02 |
| 2013/0263732 | A1 * | 10/2013 | Kucynko | 89/191.01 |
| 2014/0026459 | A1 * | 1/2014 | Yan et al. | 42/71.01 |
| 2014/0033590 | A1 * | 2/2014 | Gomez | 42/75.02 |
| 2014/0075817 | A1 * | 3/2014 | Gomez | 42/75.02 |

* cited by examiner

*Primary Examiner* — Benjamin P Lee

(74) *Attorney, Agent, or Firm* — Porzio, Bromberg & Newman P.C.

(57) ABSTRACT

An upper receiver assembly for a firearm having an upper receiver with an integral barrel nut, a handguard assembly and a barrel nut assembly with a barrel and lock nut is provided. The barrel is received by the upper receiver and is secured directly to the upper receiver using the lock nut. The upper receiver also includes an integral handguard mounting member to which the handguard assembly may be directly attached. The upper receiver assembly allows the user to attach both the barrel and handguard assemblies directly to the upper receiver, independently of one another.

18 Claims, 20 Drawing Sheets

SECTION VIEW

FIREARM RECEIVER ASSEMBLY

BACKGROUND OF THE INVENTION

1. Field of the Invention

The invention relates in general, to firearms and, more particularly, to firearm receivers which facilitate directly connecting both the barrel and the handguard directly to the receiver of the host firearm, each independent of the other.

2. Description of the Related Art

The use of autoloading rifles is prevalent with military, police and civilian shooters. Of the various autoloading rifle designs, few can compare with the popularity of the M16 family of firearms and its derivatives. The M16 family of firearms includes, but is not limited to, the AR15, M4, AR10, SR25 and piston operated designs such as LWRC International's M6 series of rifles. In general, the M16 family of firearms includes a lower receiver having a stock coupled to the rear end which is connected to an upper receiver having a barrel coupled to the front end. The chamber end of the barrel is received by a portion of the upper receiver and threadedly secured in place by a barrel nut.

Handguards are secured about the barrel to provide a surface by which the user may support the forward end of the firearm, protect the user's hand during use, and provide a mounting platform for optics, lights, lasers and other devices which may become useful. Conventional handguards found on prior art M16 type rifles are not ideal for mounting secondary devices such as lights, lasers and optics. To more easily facilitate the mounting of such devices and for other advantages, handguards which incorporate a series of MIL-STD-1913 rails, or Picatinny rails, about their exterior were developed. An example of this type of handguard is the rail adaptor system (RAS) found in U.S. Pat. No. 5,826,363. The RAS consists of an aluminum tube that replaces the conventional handguard. The tube has a series of MIL-STD-1913 rails at the 3, 6, 9, 12 o'clock positions running along the longitudinal axis of the bore. MIL-STD-1913 rails allow for the easy installation and use of various accessories which enhance the functionality of the host firearm. The aluminum tube at the heart of the RAS is secured to the prior art barrel nut and at a point on the barrel itself. By contacting the barrel, the weight of accessories mounted to the handguards can affect the zero of the host firearm.

Subsequently, a variety of designs were developed. Some early designs rely on being supported by the legacy barrel nut of the M16 family of firearms. Other designs have been developed which rely on a proprietary barrel nuts that are used to secure the handguard and barrel to the receiver, effectively "free floating" the barrel. Free floating the barrel implies that the handguard is not in direct contact with the barrel of the associated firearm. By eliminating direct contact between the handguard and the barrel, the host firearms accuracy and precision are generally improved. Further, the zero established with the host firearm will not be affected by the mounting of optics, lasers, lights or other accessories to the handguard. However, the handguard used with these free floating designs can still flex. The flexing of the handguard occurs at the junction where the handguard is attached to the barrel nut which is in direct contact with the barrel. If sufficient weight or torque is applied to the handguard, such as through the use of a vertical grip, the zero of the weapon can be compromised. This flexing of a free floating handguard can also lead to premature wear of the host firearm's bolt.

Another design path which has been taken is manufacturing the upper receiver with an integral railed handguard. An example of these so called "monolithic" upper receivers is found in U.S. Publ. No. 2011/0005384, which includes a handguard that is integral with the receiver so that the handguard assists in retaining the barrel. This configuration, and those like it, have several disadvantages. Should the handguard become damaged in anyway, the entire receiver with integral handguard must be replaced. This places a substantial financial burden upon the user. Further, the barrel is retained within the receiver extension of the receiver by securing the barrel to the handguard. Through the use of steel screws, the forward movement of the barrel is resisted. Unfortunately, the steel screws used to secure the barrel in place can potentially become over-torqued. Over-torquing the screws can cause the heli-coil threads, or their equivalent, used for retaining the screws to bind up in the receiver, making future repair difficult and expensive. Alternatively, should the threaded inserts become damaged while the screws are being secured in place, such damage could prevent the barrel from being properly secured within the upper receiver thereby rendering the host firearm inoperable.

Therefore a need exists for a receiver assembly in which the barrel and the handguard are each directly secured to the upper receiver, independently of each other.

SUMMARY OF THE INVENTION

Accordingly, the present invention is directed to an upper receiver assembly for use with M16/AR15 type weapons. The upper receiver assembly includes an upper receiver, a handguard assembly, a piston assembly and a barrel assembly. A forward face of the upper receiver has a channel which receives the chamber end of the barrel assembly. Located above the channel is an opening which receives a portion of the host firearm's gas operating system. Located adjacent to the channel is a placement for receiving and supporting the spring cup of the piston assembly and prevents the spring cup from rotating during normal operation of the host firearm.

Located about the forward end of the upper receiver assembly is a receiver extension which is generally shaped like an elongated cylinder with an upper portion removed. When viewed straight on from the front, the receiver extension looks like a "C" rotated on its side. The interior of the receiver extension is threaded to receive the lock nut which is part of the barrel assembly. The lock nut is generally circular in shape with an opening through its interior machined to receive a portion of the barrel therein. Once the barrel is inserted into the channel located at the forward end of the upper receiver, the lock nut is threadedly received by the receiver extension where it secures the barrel directly to the receiver.

The handguard assembly includes a top segment and a bottom segment separable from one another. The rear end of the bottom segment has a generally cylindrical opening and a bore that receives the receiver extension. Fasteners are used to secure the bottom segment of the handguard assembly directly to the receiver extension of the upper receiver.

In view of the foregoing, one object of the present invention is to provide an upper receiver assembly for use with an automatic firearm of the M16/AR15 type that has an upper receiver with a receiver extension, a handguard assembly, a piston assembly and a barrel assembly, the upper receiver being configured to mount each of the barrel assembly and the handguard assembly directly to the receiver extension, independently of each other.

Another object of the present invention is to provide an upper receiver assembly in accordance with the preceding object in which the barrel assembly has an integral barrel nut that is threaded for coupling with a lock ring to secure the barrel directly to the receiver extension of the upper receiver.

Yet another object of the present invention is to provide an upper receiver assembly in accordance with the preceding objects in which the receiver extension provides a mounting member that is integral with the upper receiver to which a removable handguard may be secured.

A further object of the present invention is to provide an upper receiver assembly in accordance with the preceding objects in which the upper receiver free floats the host firearm's barrel assembly without using a conventional barrel nut as a mounting point for the handguard.

A still further object of the present invention is to provide an upper receiver assembly in accordance with the preceding objects in which the upper receiver provides a mounting point for a portion of the gas operating system of the firearm.

Yet a still further object of the present invention is to provide an upper receiver in accordance with the preceding objects in which the upper receiver assembly includes a placement to receive and support the gas piston assembly of the firearm.

Another object of the present invention is to provide a locknut having a grippable structure configured to engage with a specialized wrench used to apply torque to the locknut when securing the barrel to the upper receiver.

Still another object of the present invention is to provide a locknut and wrench in accordance with the preceding object in which the grippable structure of the locknut includes a plurality of cutouts spaced around a forward face of the locknut, and the wrench includes a gripping structure embodied as a plurality of teeth which project outwardly from a forward edge of the wrench to engage with the cutouts on the locknut.

It is yet another an object of the invention to provide an upper receiver assembly in accordance with the preceding objects that is not complex in structure but yet provides for direct mounting of the barrel and the handguard assembly to the receiver extension of the upper receiver assembly, each independently of one another.

These together with other objects and advantages which will become subsequently apparent reside in the details of construction and operation as more fully hereinafter described and claimed, reference being made to the accompanying drawings forming a part hereof, wherein like numerals refer to like parts throughout.

DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended to define the limits of the invention.

DETAILED DESCRIPTION OF THE PREFERRED EMBODIMENTS

The present invention is directed towards an upper receiver assembly for use with the M16 family of firearms to include the AR15, M4, AR10, SR25 and piston operated designs such as LWRC International's M6 series of rifles. Unless otherwise specified, the various components which make up the trigger mechanism, lower receiver assembly, buttstock assembly, bolt and bolt carrier assembly are those found on the prior art M4 and M16 family of firearms.

More particularly, the present invention is an upper receiver assembly constructed to provide a mounting point for a barrel and a handguard mounting member for a handguard assembly. The barrel mounting point and handguard mounting member are integral to the receiver assembly. The novel receiver assembly facilitates the mounting of a barrel and handguard independently of each other.

As used herein, the word "front" or "forward" corresponds to the barrel end (i.e., to the right as shown in FIGS. 1, 14-15 and 17-19), and "rear" or "rearward" or "back" corresponds to the direction opposite the barrel end, where the firearm buttstock is located (i.e., to the left as shown in FIGS. 1, 14-15 and 17-19).

Figure 1:
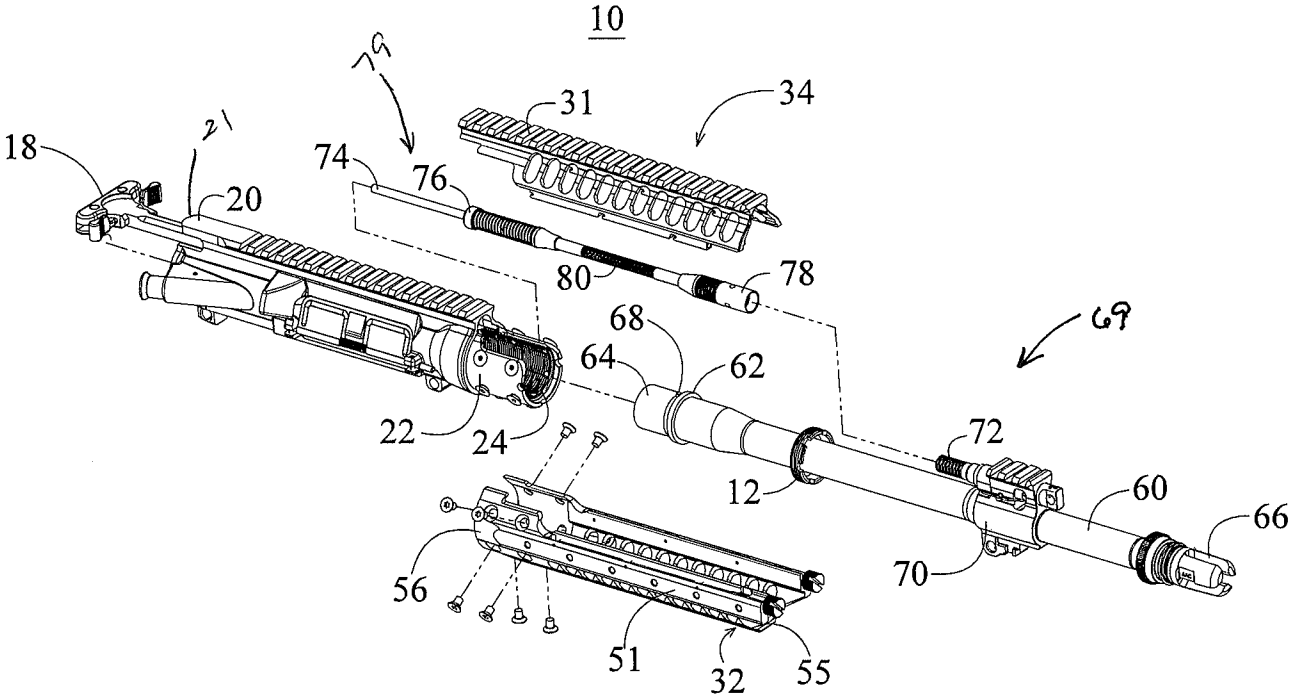
FIG. 1 is an exploded perspective view of an upper receiver assembly including an upper receiver, a handguard assembly, a piston assembly and a barrel assembly, in accordance with the present invention.
Figure 10:
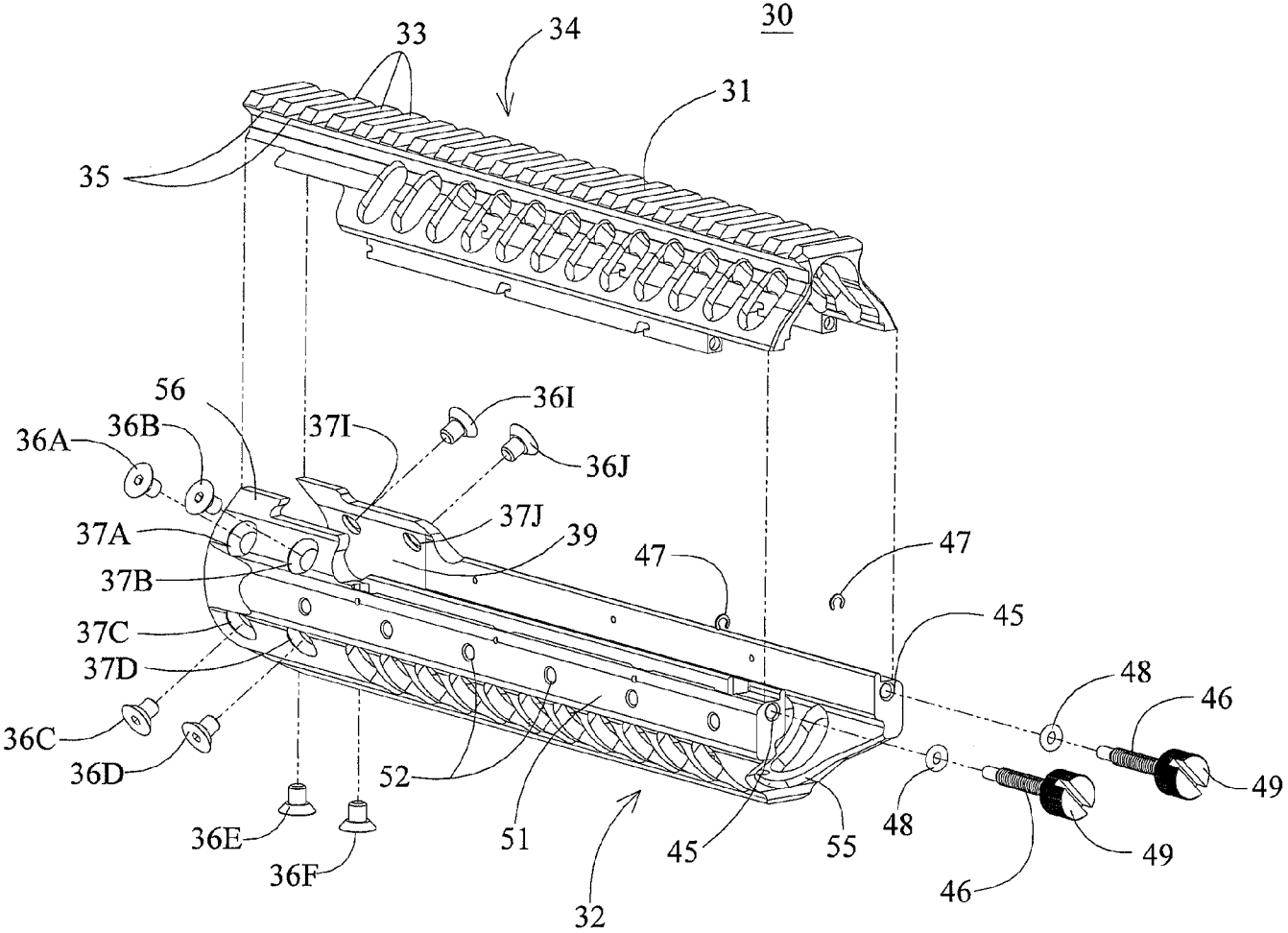
FIG. 10 is an exploded right side perspective view of the handguard assembly as shown in FIG. 1.
Figure 11:
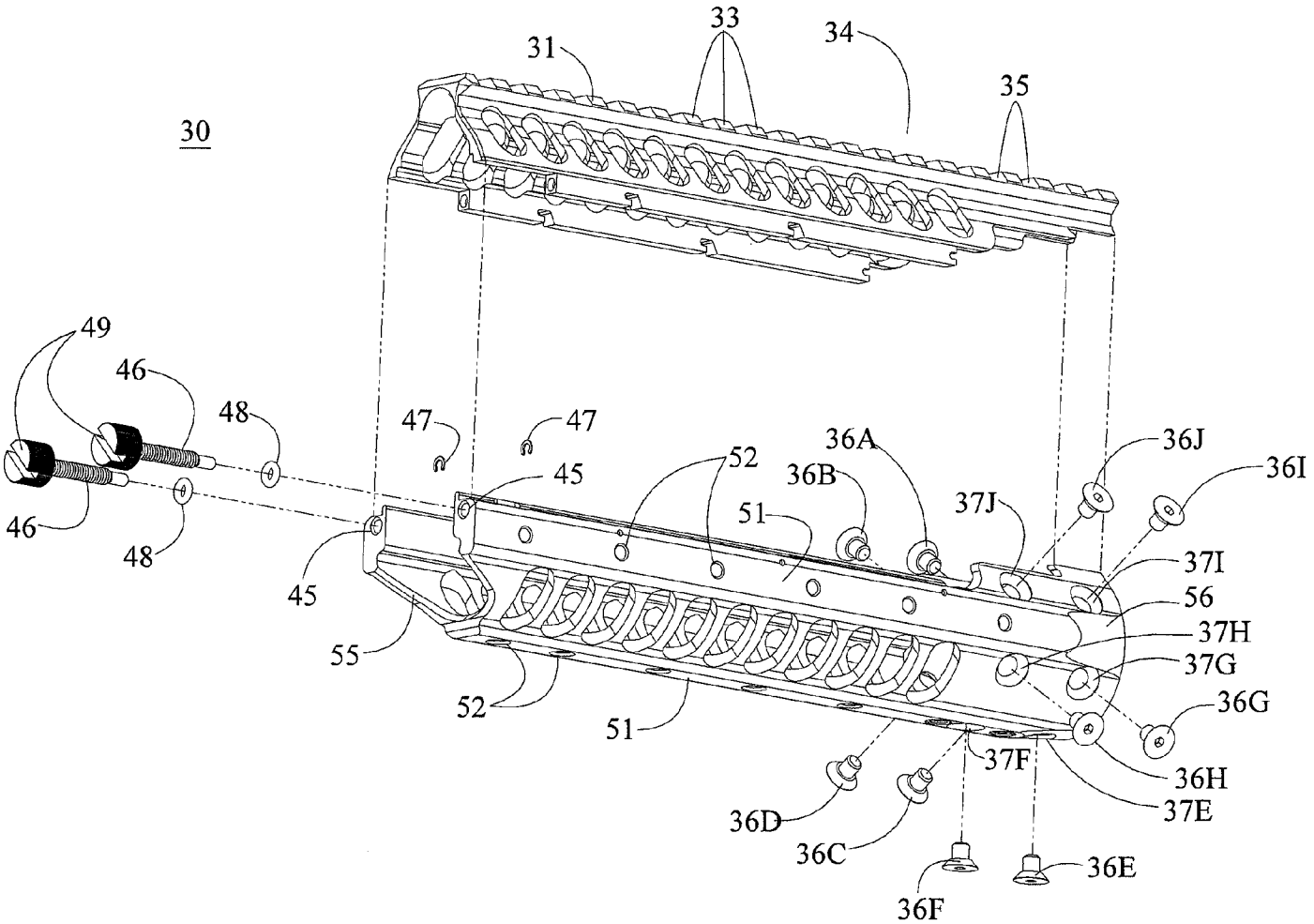
FIG. 11 is a left side perspective view of the handguard assembly shown in FIG. 10.
Figure 12:
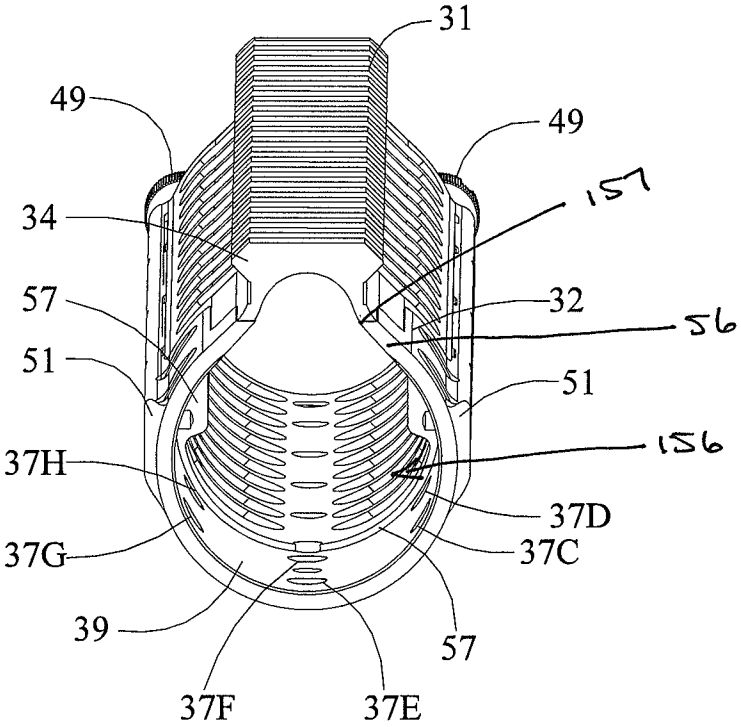
FIG. 12 is a rear perspective view of the handguard assembly shown in FIG. 10.
Figure 13:
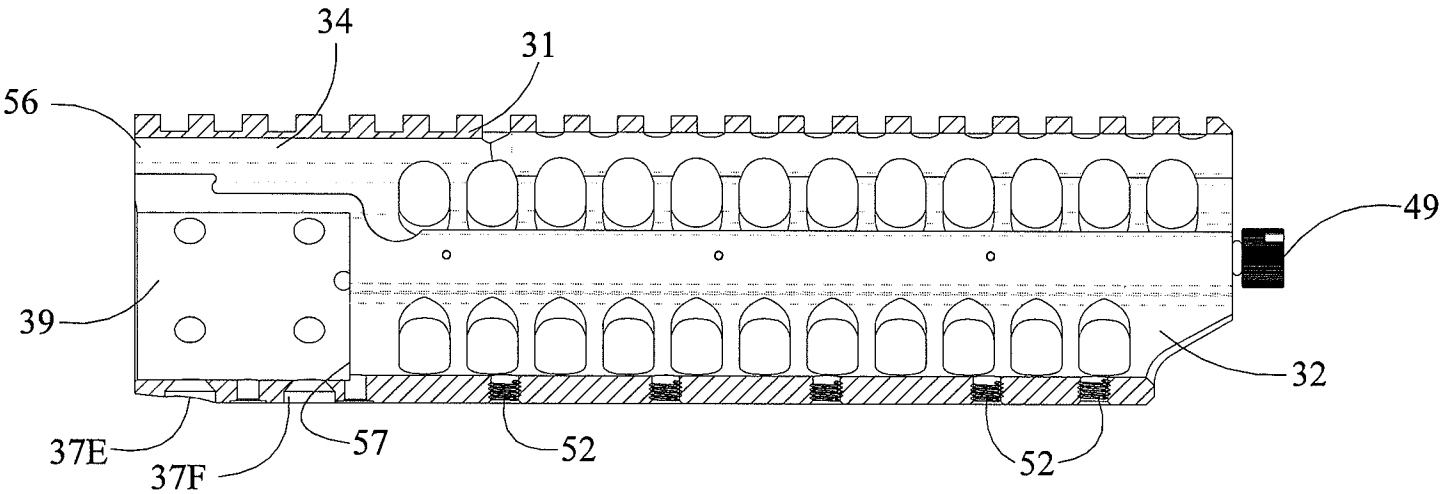
FIG. 13 is a side cutaway view of the handguard assembly shown in FIG. 10.

FIG. 1 is an exploded perspective view of a firearm upper receiver assembly 10 including an upper receiver 20, a handguard assembly generally designated by reference numeral 30 (see FIG. 10), a piston assembly generally designated by reference numeral 79 and a barrel assembly generally designated by reference numeral 69. The upper receiver 20 has a receiver extension 22 with a threaded opening 24. The threaded opening 24 of the extension member 22 is configured to threadedly receive a lock nut 12 which is used to secure the barrel to the upper receiver. The barrel assembly 69 includes a barrel 60 and is shown with a flash hider 66 threadedly secured about the end of the muzzle. The construction of the barrel 60 is of a conventional M16 type.

The rearward or chamber end 64 of the barrel 60 has an annular flange 62. An indexing pin 68 is located on the top surface of the barrel 60, between the annular flange 62 and the rearward end 64 of the barrel 60. Located near the front or muzzle end of the barrel 60 is a gas block 70 which has a gas nozzle 72 incorporated therein.

The piston assembly 79 as shown includes a piston cup 78, a connecting rod 80, a spring cup 76 and an operating rod 74. The piston assembly 79, gas nozzle 72 and gas block 70 are components of the operating system being used with the illustrated embodiment. The specific components and features which make up the piston assembly 79, gas nozzle 72 and gas block 70, along with the methods of their installation, are described in commonly owned U.S. Pat. No. 7,461,581 ("the '581 patent") which is expressly incorporated by reference as if fully set forth herein in its entirety. Any manner in which the piston assembly 79, gas nozzle 72, and gas block 70 differ from the '581 patent will be disclosed herein.

Also shown in FIG. 1 is a charging handle 18 for use in the operation of the firearm when the upper receiver assembly 10 is fully assembled. The charging handle 18 used with the upper receiver 20 can be any type which will work with prior art M16/AR15 type firearms.

The handguard assembly 30 includes a bottom segment 32 and a top segment 34. A plurality of fasteners 36 (generally ten fasteners 36A-36J) (see FIG. 10) are provided to secure the bottom segment 32 of the handguard assembly 30 to the receiver extension 22. The method of securing the top segment 34 of the handguard assembly 30 to the bottom segment 32 and the specific components used are described in commonly owned U.S. Pat. No. 8,141,289 ("the '289 patent") which is expressly incorporated by reference as if fully set forth herein in its entirety. The specific ways in which the handguard assembly 30 differs from that disclosed in the '289 patent will be disclosed herein.

Figure 2:
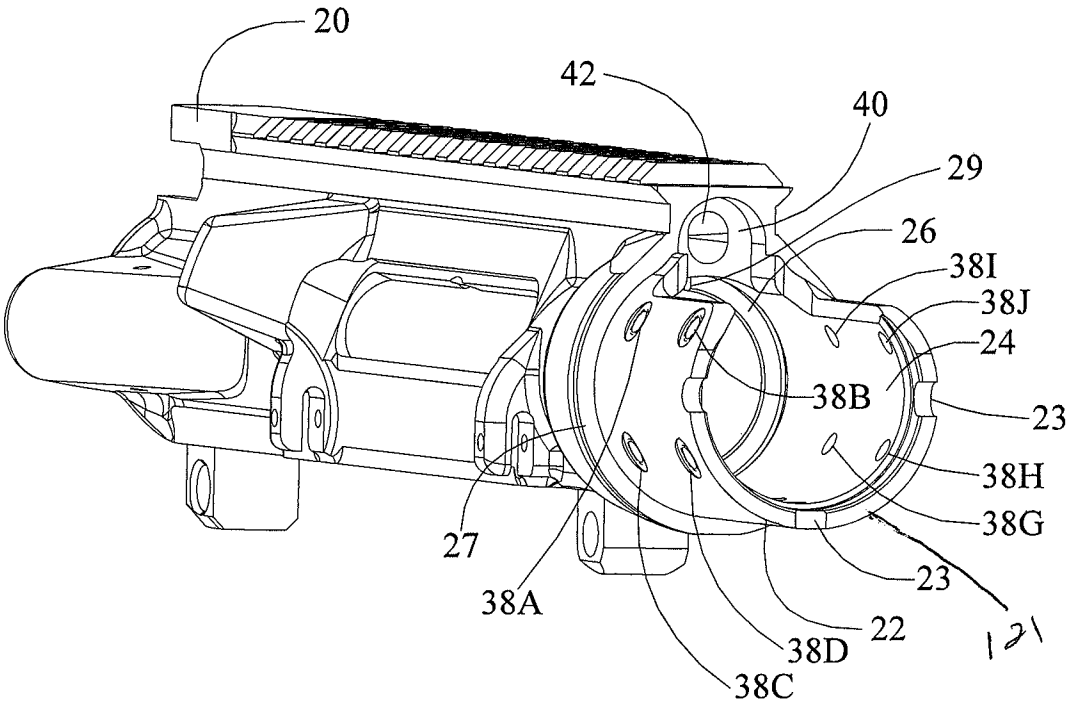
FIG. 2 is an isolated perspective view of the right side of the upper receiver as shown in FIG. 1.
Figure 3:
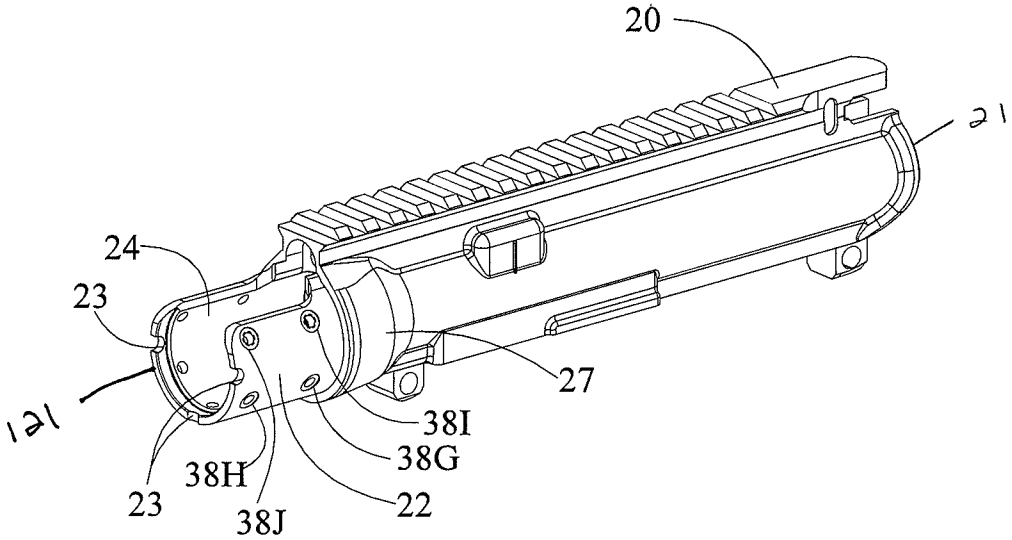
FIG. 3 is an isolated perspective view of the left side of the upper receiver shown in FIG. 2.
Figure 4:
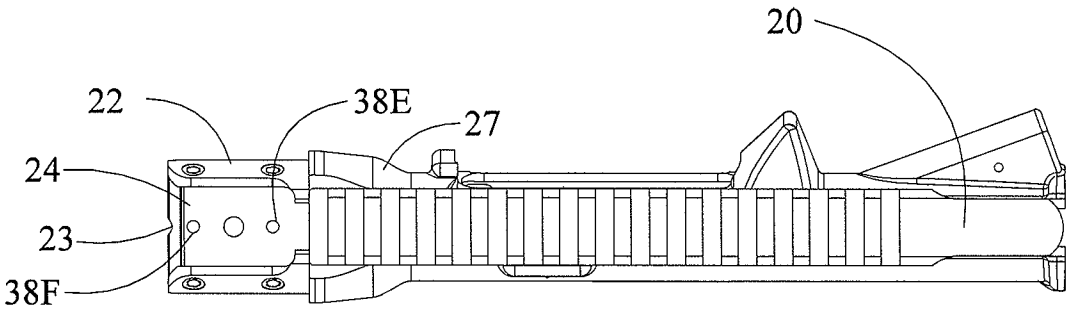
FIG. 4 is a top view of the upper receiver shown in FIGS. 2 and 3.
Figure 5:
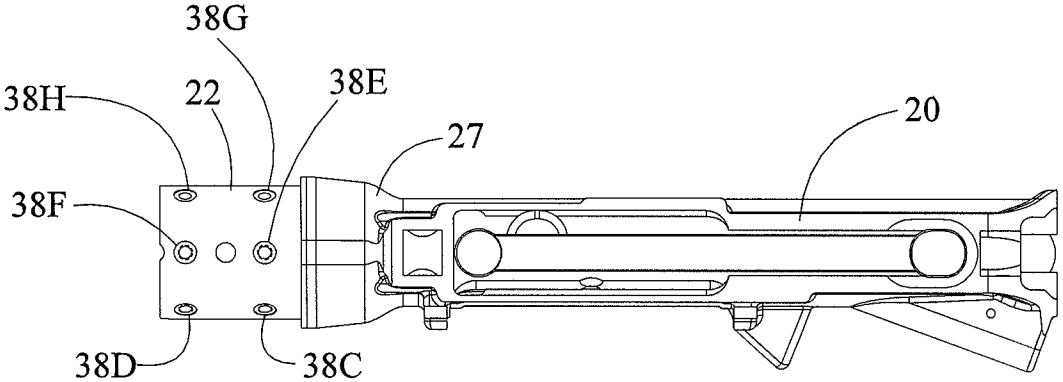
FIG. 5 is a bottom view of the upper receiver shown in FIGS. 2 and 3.

Referring now to FIGS. 2-7, several views of the upper receiver 20 are shown. The upper receiver 20 has an integral receiver extension 22. The receiver extension 22 is an elongated cylinder with a top portion removed, resulting in an approximately semi-circular opening 24, as best shown in FIG. 2. This semi-circular opening 24 is threaded about its interior and has an inside diameter sized to receive the annular flange 62 of the barrel 60. A series of threaded openings 38A-38J are located about the exterior of the receiver extension 22. Located at the forward end of the receiver extension 22 are three "U" shaped relief cuts 23. The relief cuts 23 are generally located at the 3, 6 and 9 o'clock positions about the forward face 121 of the receiver extension 22. The relief cuts 23 accommodate a portion of the screw 58 used to secure optional rail segments 50 (see FIG. 14) to the mounting surfaces 51 of the bottom segment 32 of the handguard assembly 30 (shown in FIGS. 14-17).

Figure 7:
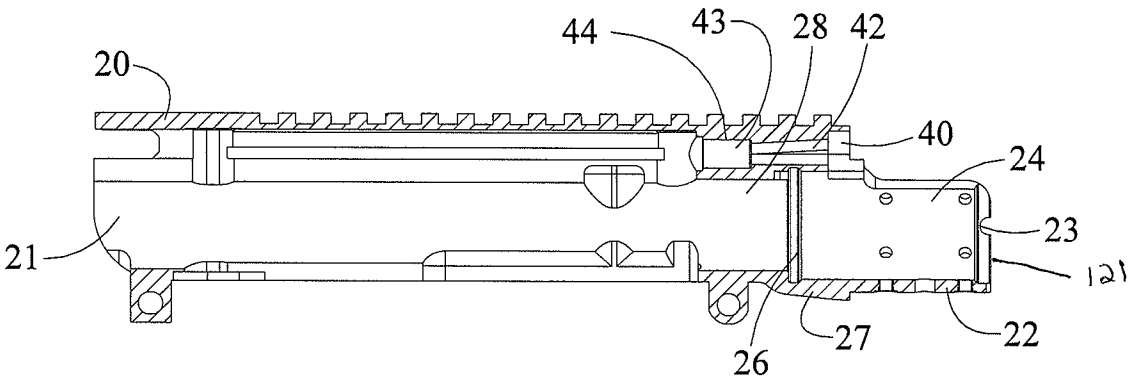
FIG. 7 is a side cutaway view of the upper receiver shown in FIG. 6, taken along line A-A.
Figure 6:
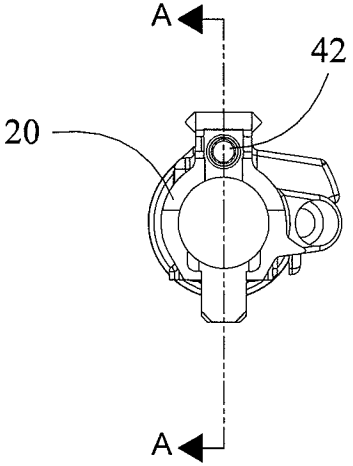
FIG. 6 is a rear view of the upper receiver shown in FIGS. 2 and 3.

Located at the back end of the interior area of the receiver extension 22 is an annular bearing surface 26 (see FIG. 7). The bearing surface 26 generally defines the opening into the longitudinally extending, chamber receiving channel 28 of the upper receiver 20. The bearing surface 26 is only broken about its top surface by a notch 29 (see FIG. 2) which receives the indexing pin 68 on the chamber end 64 of the barrel to prevent rotational movement of the barrel 60.

Located above the receiver extension 22 is a placement 40 for the spring cup 76 of the gas piston assembly. The placement is generally "U" shaped and constructed to receive and resist the rotation of the spring cup 76. The placement 40 also includes a bore 42 which is sized to receive a portion of the operating rod 74 used with the gas piston assembly. The bore 42 has a generally oval shape when viewed from the front. The bore 42 is largest at its front end and gradually tapers down in size towards its rearward end. The bottom interior wall of the bore 42 is parallel to the bore line of the barrel 60, while the gradual taper of the bore 42 (best shown in FIG. 7) is the result of its top interior wall being machined at an angle. The angle of the top interior wall of the bore 42 is selected to facilitate the installation of the piston assembly 79. Located behind and in line with the bore 42 is a placement 44 for a bushing 43. The bushing 43 is a metal cylinder with an opening therethrough which is sized to allow the passage of the operating rod 74 into the upper receiver 20 during the normal operation of the host firearm. The bushing 43 also prevents direct contact between the operating rod 74 and the upper receiver 20. Finally, the bushing 43 directs the operating rod 74 so that it makes contact with the strike face of the host firearm's bolt carrier group (not shown).

Adjacent to the receiver 22 extension is a transition portion 27 (see FIG. 14) of the upper receiver assembly 10. The transition portion 27 has a generally conical shape which tapers down in diameter towards its rearward end. The forward diameter of the transition portion 27 is greater than the exterior diameter of the receiver extension 22 and is an integral portion of the upper receiver's 20 forward end.

Figure 8:
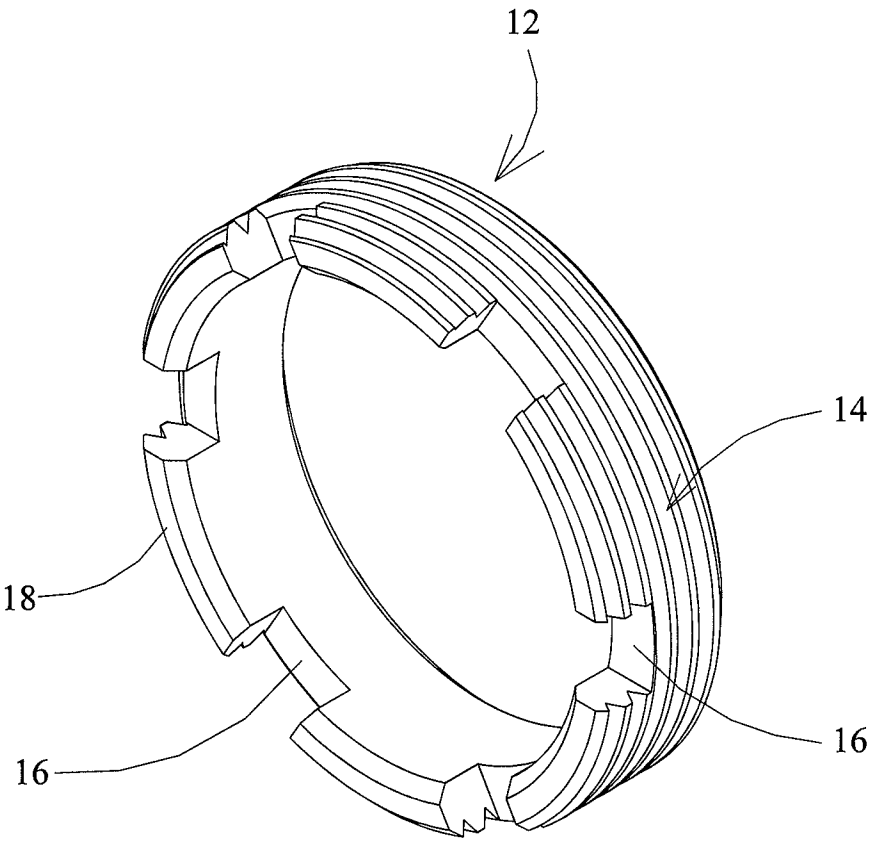
FIG. 8 is a front perspective view of the lock nut of the upper receiver assembly shown in FIG. 1.

FIG. 8 shows a front end perspective view of the locknut 12 used to secure the barrel 60 to the upper receiver 20. The locknut 12 has threads 14 about its exterior that are configured to enable the locknut 12 to be threadedly received into the threaded opening 24 of the receiver extension 22 during assembly. The locknut 12 includes a grippable structure preferably embodied as a plurality of cutouts or grooves 16 spaced evenly about the front face 18 of the locknut 12.

Figure 9B:
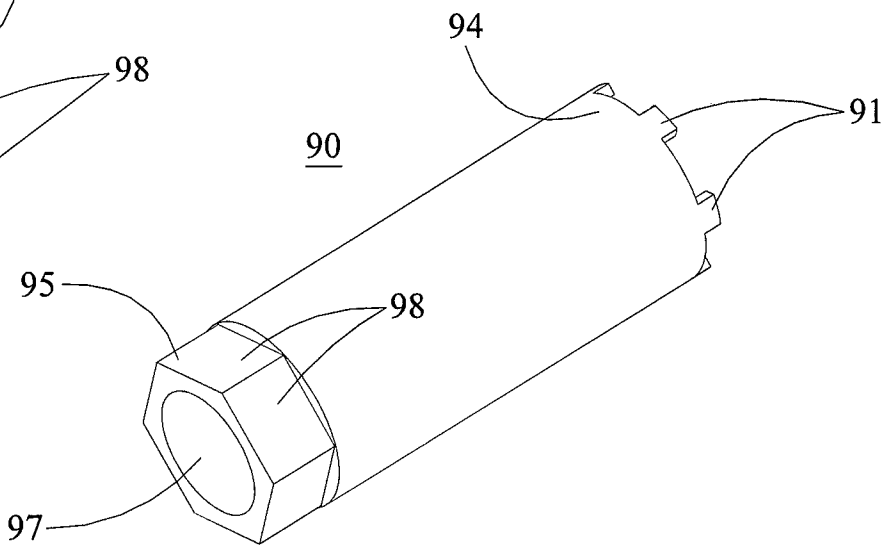
FIG. 9B is a perspective view of the wrench shown in FIG. 9A rotated 180 degrees.
Figure 9A:
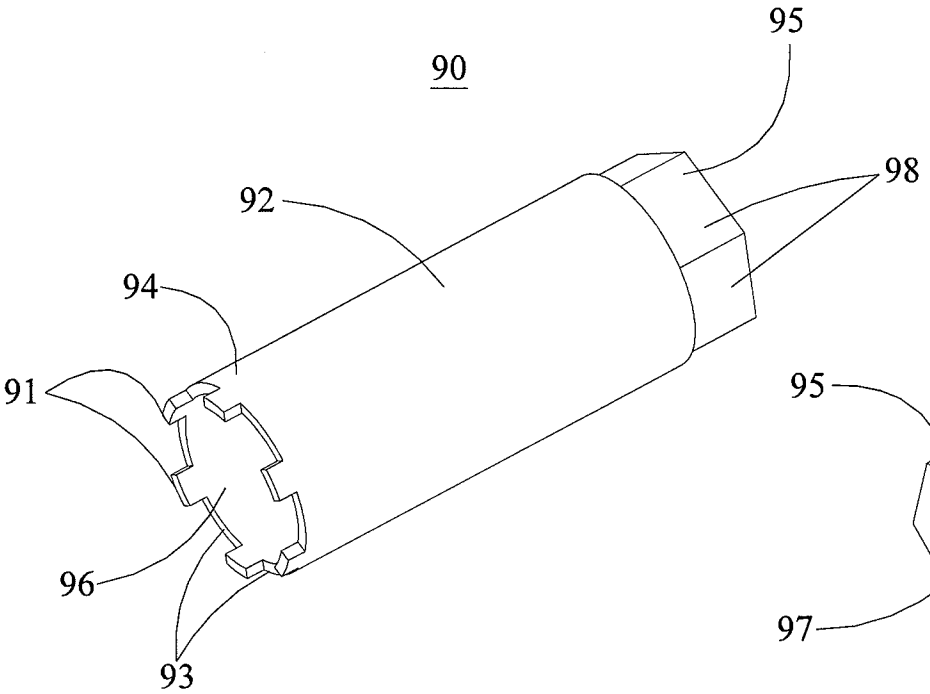
FIG. 9A is a perspective view of a specialized wrench used to secure the locknut shown in FIG. 8 against the annular flange of the barrel when securing the barrel to the receiver assembly, as shown in FIG. 1.
Figure 9C:
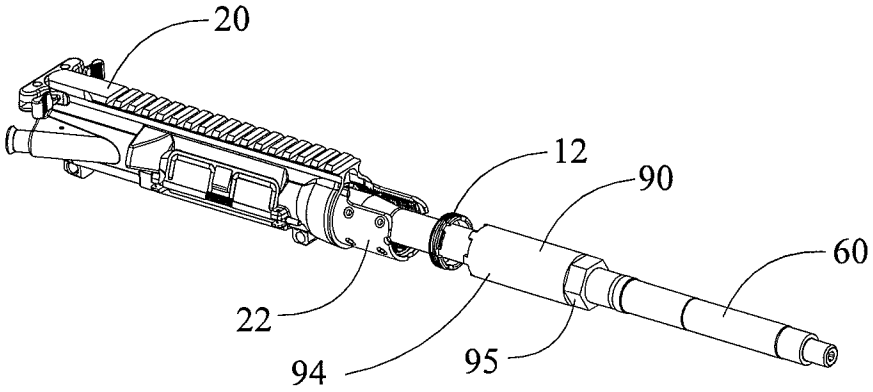
FIG. 9C is a perspective view of the upper receiver having a barrel attached thereto in accordance with the present invention.

FIGS. 9A through 9C show a specially designed wrench, generally designated by reference numeral 90, used to secure the lock nut 12 to the upper receiver 20. The wrench 90 has a cylindrical body 92 with a cylindrically shaped head, generally designated by reference numeral 94, defining a circular opening 96 having an exterior periphery. The exterior periphery includes a gripping structure embodied as a plurality of teeth 91 which project outwardly from the forward edge 93 of the cylindrical head 94. The teeth 91 are generally perpendicular to the forward edge 93 of cylindrical head 94 of the wrench 90 and are configured to engage with the cutouts or grooves 16 on the front face 18 of the lock nut 12. The body 92 has an aperture 97 therein which is configured to receive and allow the passage of the barrel 60 (shown in FIG. 9C). The proximal end 95 of the wrench 90 opposite the head 94 is shaped like a hexagon, including a series of flats 98. The flats 98 are designed to be received by virtually any type of conventional crescent wrench or similarly styled wrench found throughout the prior art. It is to be expressly understood that the flats 98 defined by the proximal end 95 of the wrench 90 can be constructed to interface with either metric or English standard wrenches.

The handguard assembly 30 is shown in FIGS. 10-13 and includes a top segment 34 and a bottom segment 32. The top segment 34 secures to the bottom segment 32 in substantially the same way as described in the '289 patent. The top segment 34 includes an integral attachment surface, generally referred to as the rail portion 31, located along its upper surface. The rail portion 31 includes a number of rails 33 extending therealong separated by traverse grooves 35 therebetween. In the illustrated embodiment, the rail portion 31 of the handguard's top segment 34 is manufactured in accordance with the MIL-STD-1913 rail specifications.

The bottom segment 32 of the handguard has a front portion 55 and a rear portion 56. The front portion 55 of the bottom segment 32 is angled to reduce weight and improve the visual appeal of the handguard assembly 30 as a whole. Located at the front portion 55 are two receptacles 45 for two pusher screws 46 that rely on c-clips 47 and o-rings 48 as a means to retain the screws 46. The head 49 of each pusher screw 46 is textured and of sufficient size to be gripped and rotated by the end user.

The rear portion 56 of the bottom segment 32 has an opening generally designated by numeral 156 into the interior of the bottom segment 32. The opening 32 is generally circular in shape with the apex 157 of the opening having been removed. Located adjacent to the opening 156 is a bore 39 which defines a portion of the bottom segment's 32 interior. The bore 39 is defined at its rearward end by the opening 156 located at the rearward end of the bottom segment 32. The forward end of the bore 39 is defined by an approximately semi-circular bearing surface 57 (see FIG. 12). The bore 39 has a smooth interior and is constructed to receive the receiver extension 22.

Located about the rear portion 56 of the bottom segment 32 are ten openings 37A-37J which extend from the exterior into the interior. These openings 37A-37J are placed to align with the threaded openings 38A-38J present about the exterior of the receiver extension 22 (see FIGS. 1-5 and 7). The openings 37A-37J are counter sunk and shaped to receive the head of the fasteners 36A-36J used to secure the bottom segment 32 to the receiver extension 22. The apex 157 of the opening 156 present on the top side of the bottom segment's 32 rear portion 56 is machined to receive a portion of the top segment 34 such that the two parts look to be one as assembled. Located at the 3, 6 and 9 o'clock positions about the exterior of the bottom segment 32 are a series of mounting surfaces 51. The mounting surfaces 51 run longitudinally the approximate length of the bottom segment 32 and are generally rectangular in shape, having a plurality of threaded openings 52 along their length.

To assemble the receiver assembly 10 as shown in FIGS. 14-20, the following steps must be taken. The upper receiver 20 is secured to a fixture (not shown) and held in a vice (not shown) to prevent unintentional rotation or movement. There are many suitable prior art fixtures which are capable of performing this task.

Initially, the bushing 43 is pressed into the placement 44 found on the interior of the upper receiver 20 (see FIG. 7). The chamber end 64 of the barrel 60 is inserted into the threaded opening 24 of the receiver extension 22. The barrel 60 is oriented during insertion so that the indexing pin 68 is received by the notch 29 located on the upper receiver 20, and the annular flange 62 comes to rest against the annular bearing surface 26 (see FIG. 7) found on the upper receiver 20. As noted previously herein, positioning of the indexing pin 68 within the notch 29 assists in preventing rotational movement of the barrel 60. A locknut 12 is then slid down the barrel so that the threads 14 of the locknut 12 may engage with the threaded opening 24 of the receiver extension 22. The wrench 90 is then slid over the barrel and used to secure the lock nut 12 in place with the appropriate pre-determined torque value (see FIG. 9C). The aperture 97 of the wrench 90 is of sufficient size to fit about the barrel 60, and the teeth 91 around the periphery of the opening 96 are constructed to interface with the cutouts 16 on the forward face of the lock nut 12. A secondary crescent style wrench is then used to apply a predetermined torque value to the locknut 12, thus securing the locknut 12 and thereby the barrel 60 to the upper receiver 20.

The gas block 70, gas nozzle 72 and flash hider 66 are installed onto the barrel 60, in a manner that is well known in the prior art. The piston assembly 79 is assembled in essentially the same manner as described in the '581 patent. Initially, the piston cup 78 is independently placed on the gas nozzle 72. The rear end of the operating rod 74 is then inserted into the bore 42 located above the chamber receiving channel 28 of the upper receiver 20 by grasping the forward end of the operating rod 74 and thereby compressing the spring of the piston assembly so that the operating rod 74 may then be rotated into a position which places it in line with the rearward face of the piston spring cup 78. While rotating the operating rod 74 into position, the spring cup 76 is received by the placement 40 machined on the forward face of the upper receiver 20. The spring cup 76 has been machined to be securely received and supported by the placement 40. Holding the operating rod 74 in its compressed position, the connecting rod 80 is then inserted into the opening (not shown) present on the forward end of the operating rod 74. This assembly is then aligned with the opening (not shown) present on the back side of the piston cup 78 and released so that a forward portion of the connecting rod 80 is received by the opening on the back side of the piston cup 78, thereby holding the operating rod 74, connecting rod 80, and piston cup 78 in operational alignment.

Next, the rearward end of the handguard's bottom segment is slid over a portion of the receiver extension 22. The receiver extension 22 is received within the bore 39 located within the rear portion 56 of the bottom segment 32. The forward edge of the receiver extension 22 comes to rest against the bearing surface 57 present at the forward end of the handguard's interior bore 39. Fasteners 36A-36J are inserted through openings 37A-37J located about the exterior of the bottom segment 32 and threadedly received by the threaded openings 38A-38J located about the receiver extension 22. The fasteners 36A-36J, when threadedly secured in place, prevent the rotational and longitudinal movement of the handguard assembly 30. The top segment 34 is then installed on the bottom segment 32 in substantially the same way as described in the '289 patent.

Figure 14:
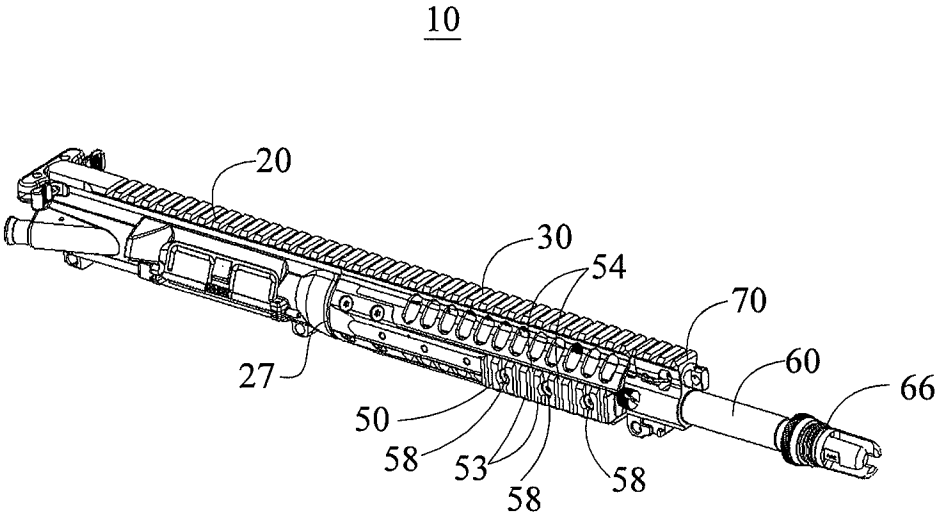
FIG. 14 is a perspective right side view of the upper receiver assembly shown in FIG. 1, as assembled.
Figure 15:
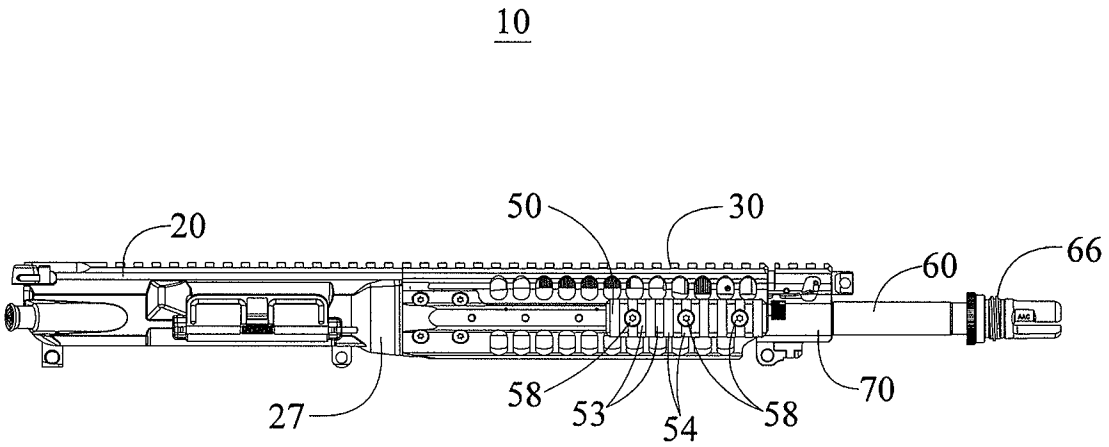
FIG. 15 is a right side view of the assembled receiver assembly shown in FIG. 14.
Figure 16:
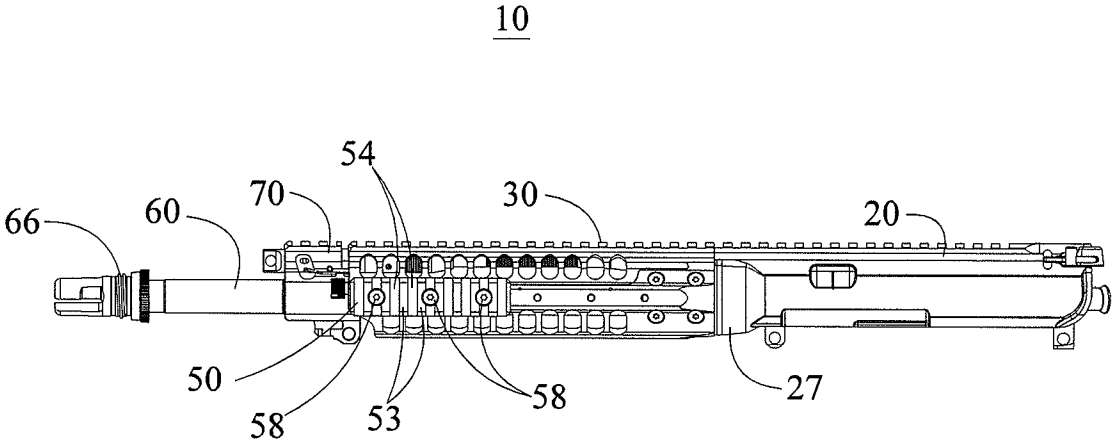
FIG. 16 is a left side view of the assembled receiver assembly shown in FIG. 14.
Figure 17:
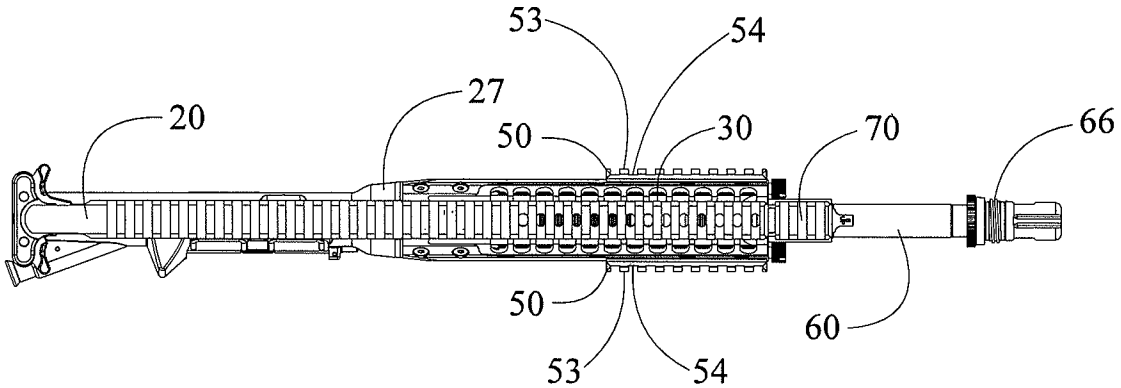
FIG. 17 is a top view of the assembled receiver assembly shown in FIG. 14.

As shown in FIG. 14, rail segments 50, also known as accessory mounting points, of various lengths may be included. The rail segments 50 are manufactured in accordance with the MIL-STD-1913 rail specifications. Each rail segment 50 includes a plurality of rails 53 separated by traverse grooves 54 located therebetween. The number of rails 53, and thus the longitudinal length of the rail segments 50, varies based on the accessories being mounted to the handguard 30. The rail segments 50 are secured to the mounting surfaces 51 of the bottom segment 32 of the handguard 30 through the use of screws 58 (shown in FIGS. 14 through 17). The screws 58 are received through bore(s) present in the rail segments 50 and threadedly received by the threaded openings 52 present on the mounting surfaces 51, thereby securing the rail segments 50 to the mounting surfaces 51. Rail segments 50 with a varying number of rails 53 may be constructed based on the end user's needs. However, the installation of the rail segments 50 onto the bottom segment 32 of the handguard assembly 30 is optional and not required.

Figure 18:
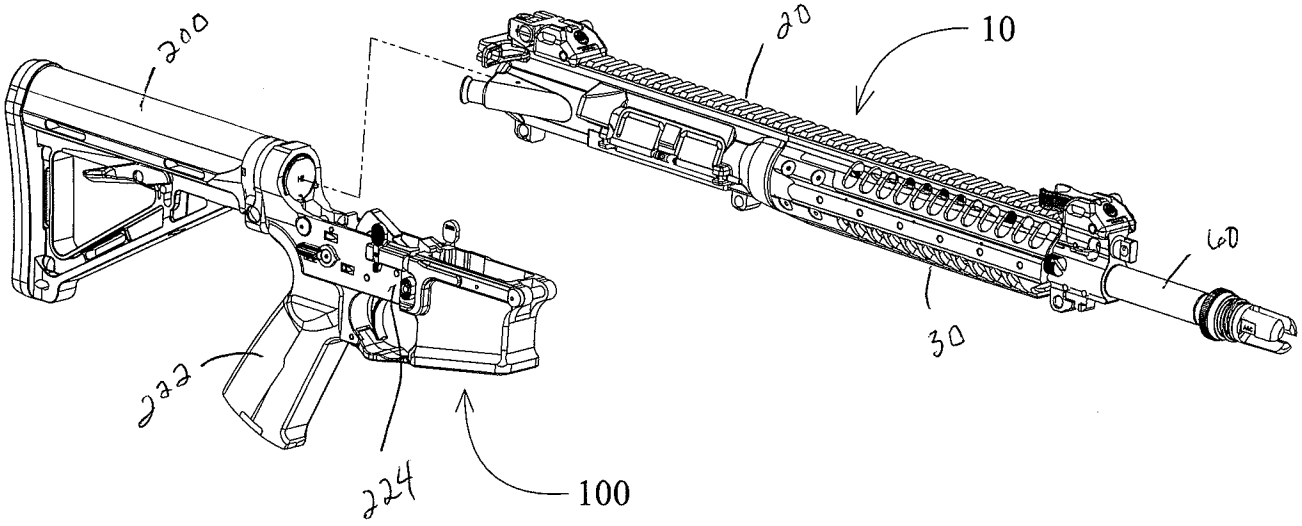
FIG. 18 is an exploded right side perspective view of a firearm including the upper receiver assembly of FIG. 1 and a lower receiver assembly.
Figure 19:
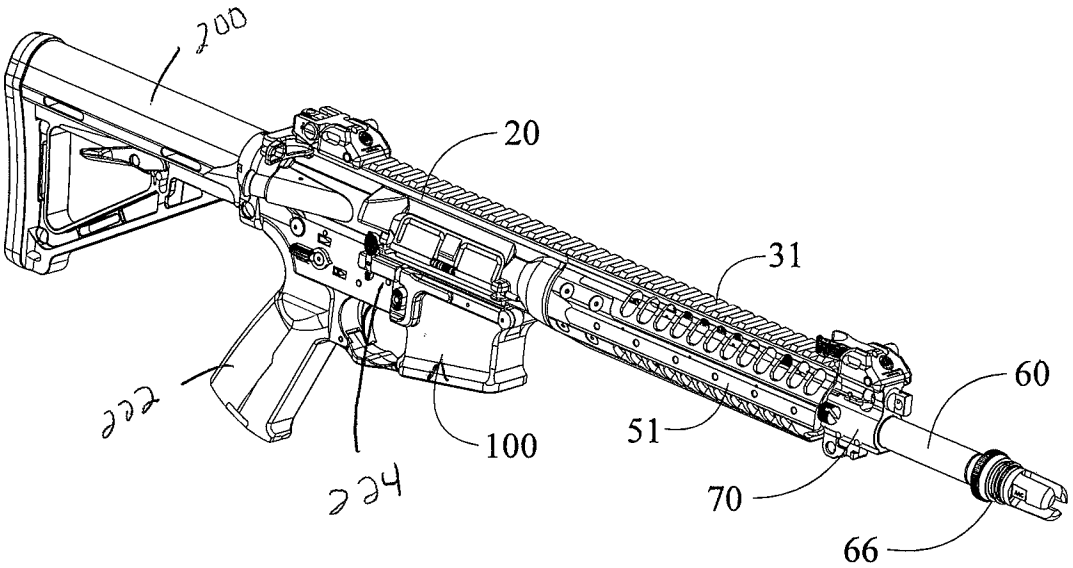
FIG. 19 is a right side perspective view of the firearm shown in FIG. 18 as assembled.
Figure 20:
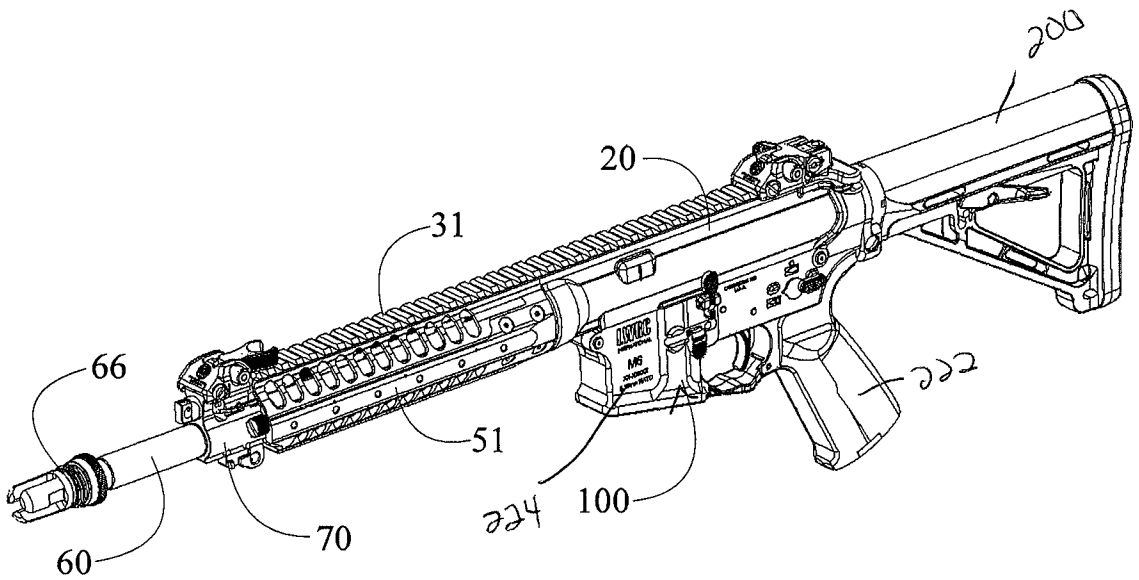
FIG. 20 is a left side perspective view of the firearm shown in FIG. 19.

FIGS. 18-20 show the receiver assembly 10 fully assembled without any rail segments 50 being attached to the handguard assembly 30. The handguard assembly 30 as disclosed herein does not directly contact the barrel 60 at any point along its length once properly installed.

When the receiver assembly 10 is assembled as described above, a bolt carrier group (well known in the prior art) is received within the interior longitudinal channel 21. The bolt carrier used will be appropriate to the specific gas operating system which was used during assembly. It should be stated that virtually any bolt carrier which works in a prior art M16/AR15 type rifle, may be received by the longitudinal channel 21 of the upper receiver 20. The receiver assembly 10 is then mated to a complete lower receiver assembly generally designated by reference numeral 100 (shown in FIGS. 18-20), consisting of a buttstock 200, pistol grip 222, lower receiver 224 and all applicable mounting hardware and required internal parts.

Thus the assembly of the new upper receiver assembly 10 has been described. By reversing the steps outlined above, the handguard assembly 30 and barrel 60 may be removed from the upper receiver 20.

Conclusion, Ramifications and Scope

The receiver assembly according to the present invention provides an apparatus and method for securing a barrel and handguard to the upper receiver of a firearm. The upper receiver 20 has been machined with an integral barrel nut portion which allows for direct attachment of the barrel 60 to the upper receiver 20 using only a lock nut 12. Further, the upper receiver 20 has been constructed to provide a placement 40 which acts as a support point for a portion of the gas operating system, again replacing the need for a traditional barrel nut. The receiver extension 22 allows for the removable handguard assembly 30 to be directly attached to the upper receiver 20, independently of the barrel 60 and absent the presence of a traditional barrel nut.

While the present preferred embodiment of the invention is shown and described, it is to be distinctly understood that this invention is not limited thereto but may be variously embodied to practice within the scope of the following claims. From the foregoing description, it will be apparent that various changes may be made without departing from the spirit and scope of the invention as defined by the following claims.

In an alternate embodiment, the piston assembly used with the present invention could be replaced with the direct gas impingement operating system common throughout the prior art with little modification to present design. Such a modification would not depart from the purpose and advantages offered by the upper receiver assembly 10 described herein.

In still another alternate embodiment, the handguard assembly 30 could be constructed to have integral rail portions at the 3, 6 and 9 o'clock positions, similar in construction to the rail segment 31 present on the top segment 34 of the handguard 30. This would necessarily replace the removable rail segments 50 used with the preferred embodiment without departing from the purposes and advantages offered by the herein disclosed apparatus.

In still yet another alternate embodiment, the handguard assembly 30 could be constructed as a single unit. In such an embodiment, the features of the bottom segment 32 and top segment 34 would be present on a single piece handguard which is received by the receiver extension 22. In this instance, all structural features which are present only to facilitate the attachment of the top segment 34 to the bottom segment 32 would be removed.

Accordingly, the scope of the invention should be determined not by the embodiments illustrated, but by the appended claims and their legal equivalents.

What is claimed is:

1. An upper receiver assembly for use with a firearm having a gas operating system, the upper receiver assembly comprising:

a barrel assembly having a barrel, an annular flange about a back end of said barrel and a lock nut encircling a portion of the barrel;

an upper receiver including a front end having a substantially cylindrical receiver extension extending therefrom, a forward end of said receiver extension having a substantially cylindrical opening with a threaded interior into which the back end of said barrel assembly is received, said front end having a bearing surface against which said annular flange of the barrel assembly rests, said threaded interior constructed to cooperate with threads on an outer surface of said lock nut so that said locknut, when threadedly secured inside the receiver extension, mounts said barrel assembly directly to said receiver extension of said upper receiver; and wherein said receiver extension is substantially shaped like an elongated cylinder with its top portion removed.

2. The receiver assembly of claim 1, further comprising a handguard assembly having a bottom segment and a separable top segment, a rear portion of said bottom segment being substantially cylindrical with a correspondingly cylindrical inner bore, a forward end of said receiver extension being received within said bottom segment inner bore and held therein to secure the handguard assembly directly to the receiver extension.

3. The receiver assembly of claim 2, further comprising a plurality of fasteners received within aligned openings in the receiver extension and openings in the bottom segment to removably secure said bottom segment of the handguard assembly to said receiver extension.

4. The receiver assembly of claim 1, further comprising a gas piston assembly and a placement above the receiver extension on a forward face of said upper receiver, said placement supporting and preventing rotation of a spring cup of said gas piston assembly.

5. The receiver assembly of claim 4, wherein said placement has a bore sized to receive a portion of an operating rod used with the gas piston assembly.

6. The receiver assembly of claim 1, wherein a forward face of said upper receiver includes an opening in communication with a channel that runs approximately parallel to the bore line of said barrel, said opening providing an entry for a portion of said gas operating system into said channel.

7. The receiver assembly of claim 6, wherein said opening in said receiver extension is machined to support a portion of said gas operating system, said opening having a forward end and a rearward end, said opening being wider at said forward end, gradually tapering down in diameter along its length towards said rearward end.

8. The receiver assembly of claim 1, further comprising a plurality of accessory mounting points which are removably secured about an exterior of a handguard assembly.

9. An upper receiver assembly for use with a gas operated firearm having a gas operating system, the upper receiver assembly comprising:

a barrel having an annular flange about its back end;

a lock nut fitted around a portion of said barrel;

an upper receiver having a receiver extension on a forward end thereof and an interior circular channel wherein a portion of said barrel is received, said receiver extension being threaded about its interior and machined to be larger in diameter than said annular flange of said barrel and to threadedly receive said lock nut, a forward end of said interior circular channel having a bearing surface against which said annular flange of said barrel rests when the barrel and upper receiver are threadedly coupled with one another and secured by the lock nut;

a handguard assembly including a top segment and a bottom segment, said bottom segment having a rearward end machined to receive and be secured to the receiver extension, said top segment being removably coupled to said bottom segment and restrained from movement by said bottom segment; and wherein said receiver extension is substantially shaped like an elongated cylinder with a top portion removed.

10. The upper receiver assembly of claim 9, further comprising a plurality of fasteners configured to removably secure said bottom portion of said handguard to said receiver extension.

11. The upper receiver assembly of claim 9, wherein said upper receiver further includes an opening located above and running parallel to said interior circular channel, said opening being configured to receive a portion of said gas operating system and rotationally restrain said portion of said gas operating system.

12. The upper receiver assembly of claim 11, wherein said opening is substantially wider at its forward end, gradually tapering down in diameter along its length towards its back end.

13. The upper receiver assembly of claim 9, further comprising a plurality of accessory mounting points which are removably secured about an exterior of said bottom segment of said handguard.

14. The receiver assembly of claim 9, wherein a rear portion of said handguard bottom segment being substantially cylindrical with a correspondingly cylindrical inner bore, said receiver extension being received within said bottom segment inner bore and secured thereto with fastening elements to mount the handguard assembly directly to the receiver extension.

15. An automatic firearm comprising:

a buttstock and pistol grip;

a lower receiver assembly;

a barrel assembly having a barrel, an annular flange about a back end of said barrel and a lock nut encircling a portion of the barrel;

a gas operating system;

an upper receiver assembly, said upper receiver assembly including, an upper receiver with a receiver extension on a forward end thereof and an interior circular channel wherein a portion of said barrel is received, said receiver extension being threaded about its interior and machined to be larger in diameter than said annular flange of said barrel and to threadedly receive said lock nut, a forward end of said interior circular channel having a bearing surface against which said annular flange of said barrel rests when the barrel and upper receiver are threadedly coupled with one another and secured by the lock nut;

a handguard assembly including a top segment and a bottom segment, said bottom segment having a rearward end machined to receive and be secured to the receiver extension, said top segment being removably coupled to said bottom segment and restrained from movement by said bottom segment; and wherein said receiver extension is substantially shaped like an elongated cylinder with its top portion removed.

16. The firearm of claim 15, wherein a forward face of said upper receiver includes an opening in communication with a channel that runs approximately parallel to a bore line of said barrel, said opening providing an entry for a portion of said gas operating system into said channel.

17. The firearm of claim 16, wherein said opening in said receiver extension is machined to support a portion of said gas operating system, said opening having a forward end and a rearward end, said opening being wider at said forward end, gradually tapering down in diameter along its length towards said rearward end.

18. The firearm of claim 15, further comprising a placement above the receiver extension on a forward face of said upper receiver, said placement supporting and preventing rotation of a spring cup of said gas operating system.

* * * * *